US007629948B2

(12) United States Patent
Chung et al.

(10) Patent No.: US 7,629,948 B2
(45) Date of Patent: Dec. 8, 2009

(54) PLASMA DISPLAY PANEL APPARATUS AND METHOD OF DRIVING THE SAME

(75) Inventors: Moon Shick Chung, Kumi-si (KR); Young Seop Moon, Kumi-si (KR)

(73) Assignee: LG Electronics Inc., Seoul (KR)

( * ) Notice: Subject to any disclaimer, the term of this patent is extended or adjusted under 35 U.S.C. 154(b) by 641 days.

(21) Appl. No.: 11/285,315

(22) Filed: Nov. 23, 2005

(65) Prior Publication Data

US 2006/0132387 A1 Jun. 22, 2006

(30) Foreign Application Priority Data

Nov. 26, 2004 (KR) ..... 10-2004-0098274

(51) Int. Cl.
*G09G 3/28* (2006.01)
*G09G 5/00* (2006.01)

(52) U.S. Cl. ..... 345/60; 345/208

(58) Field of Classification Search ..... 345/60, 345/69, 208, 690; 315/169.4
See application file for complete search history.

(56) References Cited

U.S. PATENT DOCUMENTS

2002/0011800 A1* 1/2002 Schermerhorn et al. .. 315/169.4
2002/0196243 A1* 12/2002 Morita ..... 345/204
2005/0093470 A1* 5/2005 Choi ..... 315/169.4
2008/0191972 A1* 8/2008 Kim et al. ..... 345/63

* cited by examiner

*Primary Examiner*—Bipin Shalwala
*Assistant Examiner*—Ilana Spar
(74) *Attorney, Agent, or Firm*—Birch, Stewart, Kolasch & Birch, LLP

(57) ABSTRACT

A plasma display panel apparatus and a method of driving the same are disclosed. Right after power is supplied to a panel, driving waveforms are applied such that an address discharge and a sustain discharge cannot occur during at least one or more sub-fields. Accordingly, time for a source capacitor of an energy recovery unit provided in a scan driver and a sustain driver to be charged with a voltage can be secured and a preliminary time for an element of the driving circuit and the discharge cell to be activated can be secured, to thereby prevent damage of the element.

18 Claims, 10 Drawing Sheets

PLASMA DISPLAY PANEL APPARATUS AND METHOD OF DRIVING THE SAME

BACKGROUND OF THE INVENTION

1. Field of the Invention

The present invention relates to a plasma display panel (PDP) apparatus and a method for driving the same and, more particularly, to a PDP apparatus capable of protecting an element of a driving circuit and a discharge cell by securing time for activating the element by applying a reset waveform and a modified sustain waveform during at least one or more sub-fields right after power is applied to the panel, and a method of driving the same.

2. Description of the Related Art

A plasma display apparatus is an apparatus in which discharge cells are formed between a rear substrate with barrier ribs formed thereon and a front substrate facing the rear substrate, and when an inert gas inside each discharge cell is discharged by a high frequency voltage, vacuum ultraviolet rays are generated to illuminate phosphor to thereby allow displaying of images.

FIG. 1 is a perspective view showing the structure of a general PDP, and FIG. 2 is a sectional view showing a discharge cell of the general PDP.

To begin with, discharge cells are formed by a plurality of barrier ribs 24 separating a discharge space on a rear substrate 18 facing a front substrate 10.

An address electrode X is formed on the rear substrate 18, and a scan electrode Y and a sustain electrode Z are formed as a pair on the front substrate 10. The address electrode X crosses the other electrodes Y and Z, and in this respect, the rear substrate 18 in FIG. 2 is shown as having been rotated by 90° for the sake of explanation.

A dielectric layer 22 for accumulating wall charges is formed on the rear substrate 18 with the address electrode X formed thereon.

The barrier ribs 24 are formed on the dielectric layer 22 to define a discharge space therebetween and prevent a leakage of ultraviolet rays and visible light generated by a discharge to an adjacent discharge cell. Phosphor 26 is coated on the surface of the dielectric layer 22 and on the surface of the barrier ribs 24.

Because an inert gas is injected into the discharge space, the phosphor 26 is excited by the ultraviolet rays generated during a gas discharge to generate one of red, green and blue visible light.

The scan electrode Y and the sustain electrode Z formed on the front substrate 10 include transparent electrodes 12Y and 12Z and bus electrodes 13Y and 13Z, respectively, and cross the address electrode 12X. A dielectric layer 14 and a protective film 16 are formed to cover the scan electrode Y and the sustain electrode Z.

The discharge cell with such a structure is selected by a facing discharge formed between the address electrode X and the scan electrode Y, and the discharge is sustained by a surface discharge between the scan electrode Y and the sustain electrode Z, to thus emit visible light.

The scan electrode Y and the sustain electrode Z include the transparent electrodes 12Y and 12Z and the bus electrodes 13Y and 13Z having the smaller width than the transparent electrodes 12Y and 12Z and formed on one edge portion of the transparent electrodes 12Y and 12Z, respectively.

FIG. 3 shows a frame of the general PDP and FIG. 4 is a view showing waveforms according to a method for driving a PDP in accordance with a related art.

With reference to FIG. 3, in the plasma display panel, in order to represent gray levels of an image, one frame is divided into several sub-fields each having a different number of times of illumination and driven according to time division. Each sub-field (SF1~SF8) includes a reset period (RPD) for initializing wall charges in the discharge cell, an address period (APD) for selecting a scan line and then selecting a discharge cell from the selected scan line, and a sustain period (SPD) for implementing gray levels according to the number of times that a sustain discharge occurs.

Gray levels implemented in the sub-fields including the reset period (RPD), the address period (APD) and the sustain period (SPD) are accumulated during one frame, and in case where an image is represented with 256 gray levels, as shown in FIG. 3, a frame period (16.67 ms) corresponding to 1/60 seconds is divided into eight sub-fields (SF1 to SF8) and each sub-field represents $2^n$ (n=0, 1, 2, 3, 4, 5, 6, 7) gray levels.

Driving waveforms in a sub-field will now be described with reference to FIG. 4. A reset waveform (RP) supplied to the scan electrode (Y) during the reset period (RPD) includes a set-up waveform rising in a ramp form and a set-down waveform falling in the ramp form. As a voltage of the panel is increased by the set-up waveform, a reset discharge occurs and wall charges are formed at the dielectric layer 14. And, as the voltage of the panel is decreased by the set-down waveform, some unnecessary wall charges are erased.

During the address period (APD), a scan waveform (SP) having a negative (−) scan voltage (Vy) is supplied to the scan electrode (Y) and, at the same time, a data waveform (DP) is supplied to the address electrode (X), to make an address discharge occur.

During the sustain period (SPD), sustain waveforms SusPz and SusPy having repeated high and low potential voltage levels are alternately supplied to the scan electrode (Y) and the sustain electrode (Z), to make a sustain discharge occur.

Meanwhile, an energy recovery unit, provided in a scan driver and a sustain driver which apply driving waveforms to the scan electrode (Y) and the sustain electrode (Z), respectively, recovers energy from the panel during the sustain period (SPD) and re-supplies it during the sustain period (SPD). Thus, when the panel is initiated to be driven after having been sustained in an OFF state for a long time, a panel voltage cannot be recovered by the energy recovery unit, so quality of a displayed image is degraded due to a weak sustain discharge during the sustain period right after the initiation of the driving of the panel.

In addition, when the panel is initiated to be driven after having been sustained in the OFF state for a long time, a high voltage is suddenly supplied to an element of a circuit for driving the PDP and the discharge cell, the element is inevitably damaged.

In more detail, generally, an element mounted in the driving circuit or in the discharge cell needs a certain preliminary time for allowing the element to be activated in a stable state. Thus, in this respect, if a high voltage is applied to the element without having such a preliminary time, the element would be suddenly turned to the activated state, and thus, electrical/physical characteristics of the element are changed or damaged.

In particular, as shown in FIG. 5, there is a high possibility that the element in the driving circuit and in the discharge cell is damaged due to a voltage difference (Vxy) between the scan electrode (Y) and the sustain electrode (Z) during the sustain period (SPD) during which the sustain waveforms SusPz and SusPy are alternately applied to both electrodes.

Namely, when the power supply to and power cutoff from the PDP are repeated or when the waveforms having repeated rising and falling levels like the sustain waveforms SusPz and SusPy are supplied, not only the electrical/physical characteristics of the element of the driving circuit and the discharge cell would be changed but also a lifespan of the PDP would be reduced.

SUMMARY OF THE INVENTION

The present invention is designed to solve such problem of the related art, and therefore, an object of the present invention is to provide a plasma display panel (PDP) apparatus capable of protecting an element of a driving circuit and a discharge cell by securing time for activating the element by applying a reset waveform and a modified sustain waveform during at least one or more sub-fields right after power is applied, and a method of driving the same.

To achieve the above object, there is provided a plasma display panel (PDP) apparatus including a panel, a sustain driver and a scan driver. The panel includes at least one or more electrodes. The sustain driver and the scan driver include a sustain electrode and a scan electrode, respectively. The scan driver applies a first waveform during a sustain period without having an address period during at least one or more frames right after power is supplied to the panel. The sustain driver applies a second waveform during the sustain period.

Namely, right after power is supplied to the panel, at least one sub-field of a frame includes a reset period during which a reset waveform for initializing a cell is applied to one of the scan electrode and the sustain electrode, and a sustain period during which a first waveform is applied to one electrode and a second waveform having a voltage difference from that of the first waveform smaller than a sustain discharge initiation voltage is applied to the other electrode after the reset period without having an address period.

The first waveform is a sustain waveform having repeated high and low voltages, and the second waveform is smaller than a maximum voltage level of the first waveform and maintained a certain voltage level.

The first waveform is a sustain waveform having repeated high and low voltages, and the second waveform is a waveform falling in a ramp form from a certain voltage level.

The sub-field including the reset period and the sustain period without the address period is at least one or more sub-fields of a first frame right after power is supplied to the panel or one or more sub-fields of several frames right after power is supplied to the panel.

Thus, because the sub-field includes the sustain period, omitting the address period, during which the first and second waveforms having a voltage difference smaller than the sustain discharge initiation voltage are applied, so a certain preliminary time required for an element in a driving circuit or in a discharge cell to be activated during the sub-field and time for recovering energy to a source capacitor of an energy recovery unit can be secured (obtained) before an image is displayed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

The plasma display panel (PDP) apparatus and driving waveforms during a sub-field for securing time for activating an element in accordance with preferred embodiments of the present invention will now be described.

There can be a plurality of embodiments of the PDP in accordance with the present invention without being limited to those described in the present invention.

The preferred embodiments of the present invention will now be described with reference to FIGS. 6 to 10. Capacitance exists between a scan electrode and a sustain electrode, which is called a panel capacitor, and a voltage difference formed between (across) the two electrodes is called a panel voltage ($V_{YZ}$).

Figure 6:
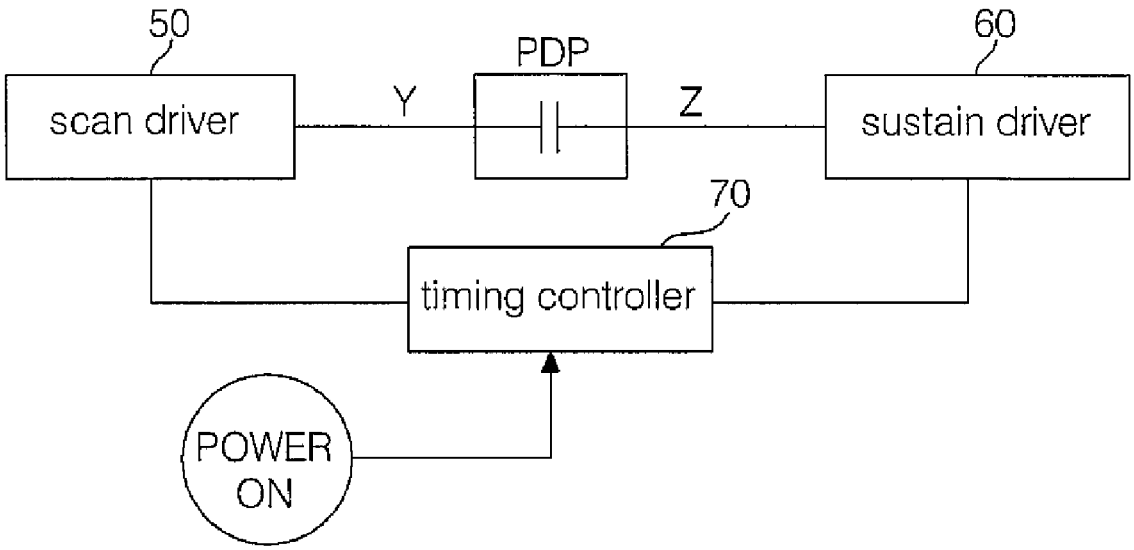
FIG. 6 is a schematic block diagram of an apparatus for driving a PDP in accordance with the present invention.

FIG. 6 is a schematic block diagram of an apparatus for driving a PDP in accordance with the present invention. The apparatus for driving the PDP in accordance with the present invention includes a panel (PDP) having at least one or more electrodes, a scan driver 50 and a sustain driver 60 for driving a scan electrode (Y) and a sustain electrode (Z), respectively, and a timing controller 70 for controlling a switch timing of the scan driver 50 and the sustain driver 60 so that driving waveforms as shown in FIGS. 7 to 10 can be applied right after power is supplied to a circuit to thereby secure a preliminary time required for activating an element of a driving circuit and a discharge cell.

Right after power is supplied to the panel, the scan driver 50 and the sustain driver 60 applies driving waveforms during a reset period and a sustain period without having an address period during at least one or more sub-fields under the control of the timing controller 70.

When a sub-field consisting of the reset period and the sustain period is an element activation sub-field for the sake of convenience, the element activation field forms at least one frame right after power is supplied.

The scan driver 50 applies a set-up waveform rising in a ramp form and a set-down waveform falling in the ramp form during the reset period of the element activation sub-field. At this time, the sustain driver 60 applies a positive polarity bias voltage during the period while the set-down waveform is applied.

The scan driver 50 applies a first waveform during the sustain period following the reset period and the sustain driver 60 applies a second waveform different from the first waveform.

The timing controller 70 controls a switch timing of the scan driver 50 and the sustain driver 60 so that wall charges in the discharge cell can be gradually formed without an address discharge and a sustain discharge during the element activation sub-field right after power is supplied to the panel.

In this case, one of the first and second waveforms is a sustain waveform having repeated high and low potentials, and the other is a waveform making the panel voltage be smaller than a sustain discharge initiation voltage, which will now be described in detail with reference to FIGS. 7 to 10.

FIGS. 7 to 10 show first to fourth embodiments of driving waveforms supplied by the scan driver and the sustain driver during the element activation sub-field in accordance with the present invention.

Figure 7A:
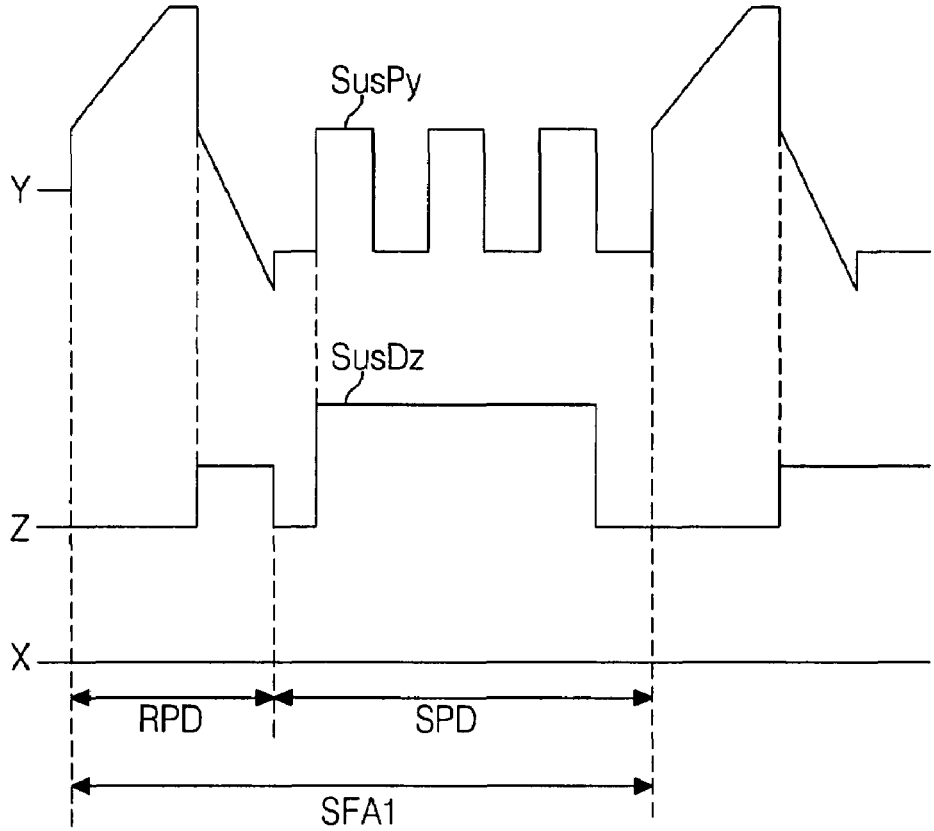
FIG. 7*a* is a view showing a first embodiment of driving waveforms of the PDP in accordance with the present invention.

With reference to FIG. 7*a*, after power is supplied to the panel, the element activation sub-field (SFA1) included in at least one or more frames is driven by being divided into the reset period (RPD) and the sustain period (SPD), excluding an address period.

The reset waveform (RP) is supplied to the scan electrode (Y) during the reset period (RPD). The reset waveform (RP) increases the panel voltage by the set-up waveform rising in the ramp form and decreases the panel voltage by the set-down waveform falling in the ramp form.

As a reset discharge occurs by the set-up waveform, wall charges are formed at the dielectric layer, and as the panel voltage is decreased by the set-down waveform, unnecessary wall charges are partially erased.

When the reset waveform (RP) is set down, since a positive polarity DC voltage is supplied to the sustain electrode (Z), the scan electrode (Y) has a negative (−) polarity, and thus, the wall charges generated during the set-up are reduced.

During the sustain period (SPD), the first waveform (SusPy) having repeated high and low potentials is applied to the scan electrode (Y) and the second waveform (SusDz) maintaining a certain voltage level is applied to the sustain electrode.

The first and second waveforms SusPy and SusDz are simultaneously increased from a sustain bias voltage, and a maximum voltage of the second waveform is a maximum voltage of the first waveform.

As shown in FIG. 7, the first waveform (SusPy) and the second waveform (SusDz) which are applied to the sustain electrode (Y) and the sustain electrode (Z), respectively, during the sustain period (SPD), and the panel voltage ($V_{YZ1}$) are smaller than the panel voltage ($V_{YZ}$) as in the related art Namely, as for the element activation sub-field (SFA1) in accordance with the first embodiment of the present invention, since there is no address period, a discharge cell is not selected, and since the panel voltage ($V_{YZ1}$) is smaller than the sustain discharge initiation voltage during the sustain period (SPD), an image is not displayed.

Accordingly, during the sustain period during which the first waveform (SusPy) having repeated high and low potentials is applied by the scan driver 50 and the second waveform (SusDz) that maintains the positive polarity potential is applied by the sustain driver 60, time for the source capacitor of the energy recovery unit to be charged can be secured, and a preliminary time for the element of the driving circuit or the discharge cell to be turned to an activated state during the element activation sub-field (SFA1) can be secured.

The element activation sub-field (SFA1) can be not only the first sub-field of the frame but also can extend to the next sub-field right after power is supplied to the panel, and also can be the entire sub-fields of one frame as necessary.

Figure 8A:
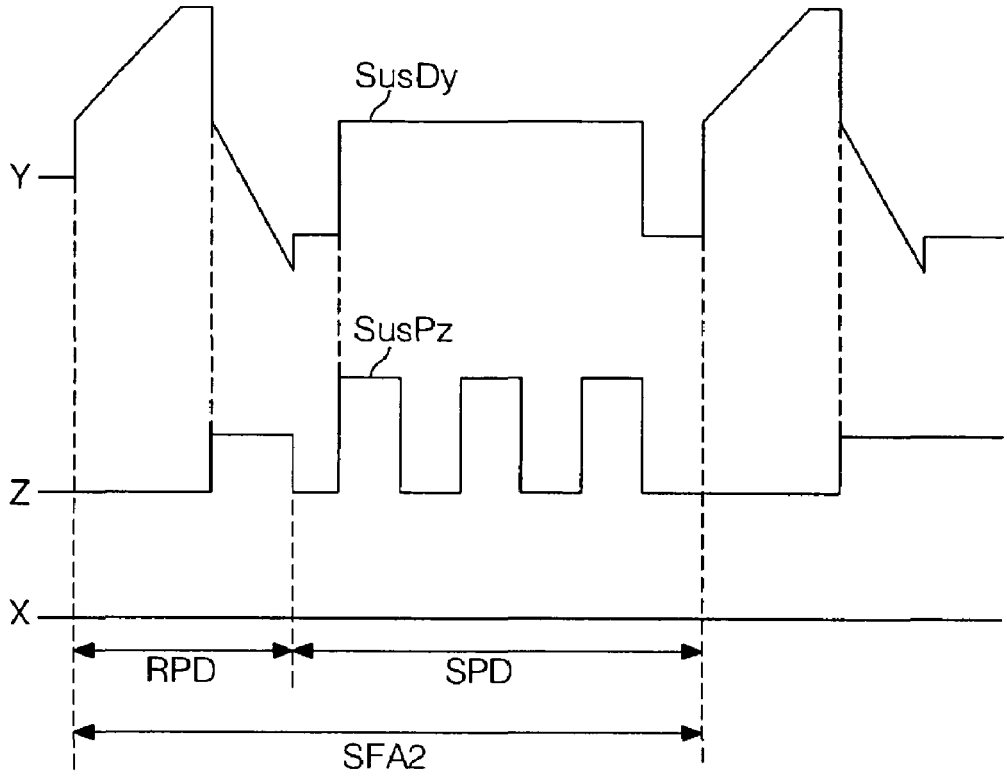
FIG. 8*a* is a view showing a second embodiment of driving waveforms of the PDP in accordance with the present invention.
Figure 8B:
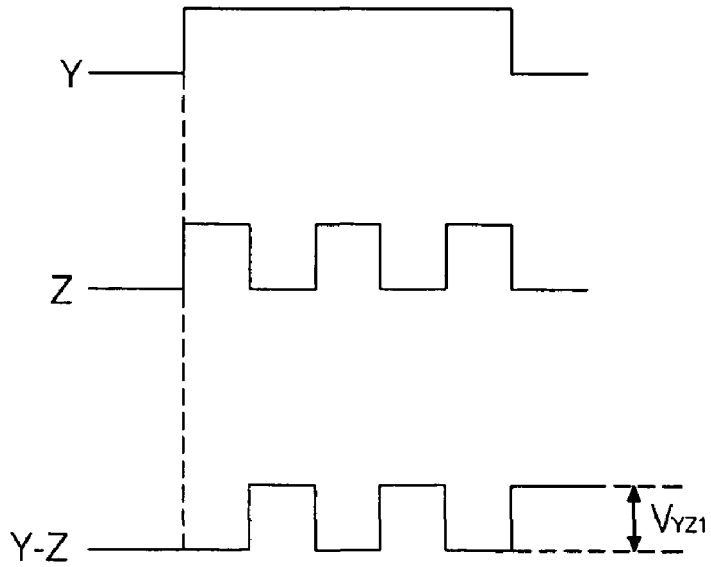
FIG. 8*b* is a view showing a voltage difference between the scan electrode and the sustain electrode when the driving waveforms according to the second embodiment are applied.

In a second embodiment of the present invention with reference to FIGS. 8*a* and 8*b*, a first waveform (SusPz) can be applied to the sustain electrode (Z) and the second waveform (SusDy) can be applied to the scan electrode (Y) during the sustain period (SPD).

Accordingly, during the sustain period (SPD) during which a second waveform (SusDy) that sustaines the positive polarity potential is applied by the scan driver 50 and a first waveform (SusPz) having repeated high and low potentials is applied by the sustain driver 60, time for the source capacitor of the energy recovery unit to be charged can be secured, and a preliminary time for the element of the driving circuit and the discharge cell to be turned to an activation state during an element activation sub-field (SFA2) can be secured.

Figure 7B:
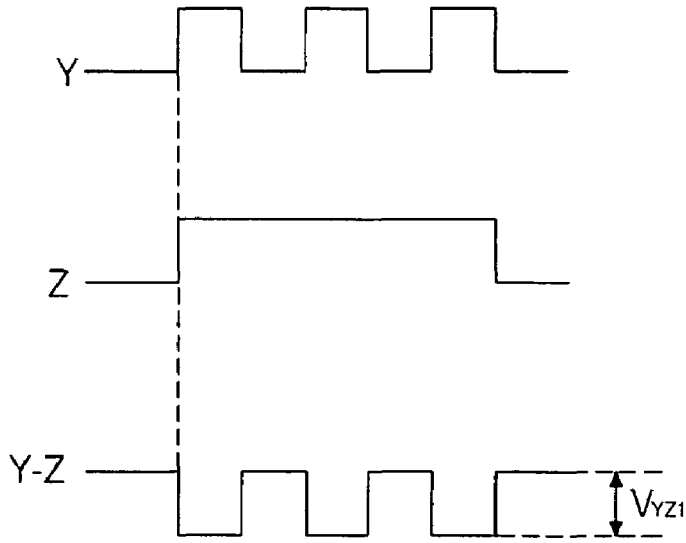
FIG. 7*b* is a view showing a voltage difference between the scan electrode and the sustain electrode when the driving waveforms according to the first embodiment are applied.

With reference to FIGS. 7*b* and 8*b*, when the driving waveforms in accordance with the first and second embodiments of the present invention are applied during the sustain period (SPD), the panel voltage ($V_{YZ1}$) is smaller than the sustain discharge initiation voltage, a sustain discharge does not occur.

FIGS. 9*a* to 10*b* show third and fourth embodiments of driving waveforms supplied by the scan driver and the sustain driver in accordance with the present invention.

An element activation sub-field (SFA3) in accordance with the third embodiment of the present invention is driven in the same manner as in the first embodiment of the present invention except for driving waveforms applied to the scan electrode (Y) and the sustain electrode (Z) during the sustain period (SPD), descriptions of which are thus omitted.

During the sustain period (SP) in accordance with the third embodiment of the present invention, a first waveform (SusPy) having repeated high and low potentials is applied to the scan electrode (Y) and a second waveform (SusRz) falling in the ramp form from a certain voltage level is applied to the sustain electrode (Z).

In order to apply the second waveform (SusRz) falling in the ramp form, a variable resistor circuit for forming the ramp waveform is connected with a switch in the sustain driver 60.

That is, in the third embodiment of the present invention, during the sustain period (SPD) during which the first waveform (SusPy) having repeated high and low potentials is applied by the scan driver 50 and the second waveform (SusRz) falling in the ramp form from the positive polarity potential is applied by the sustain driver 60, time for the source capacitor of the energy recovery unit to be charged can be secured and a preliminary time for the element of the driving circuit and the discharge cell to be turned to an activation state during the element activation sub-field (SFA3) can be secured.

Figure 10A:
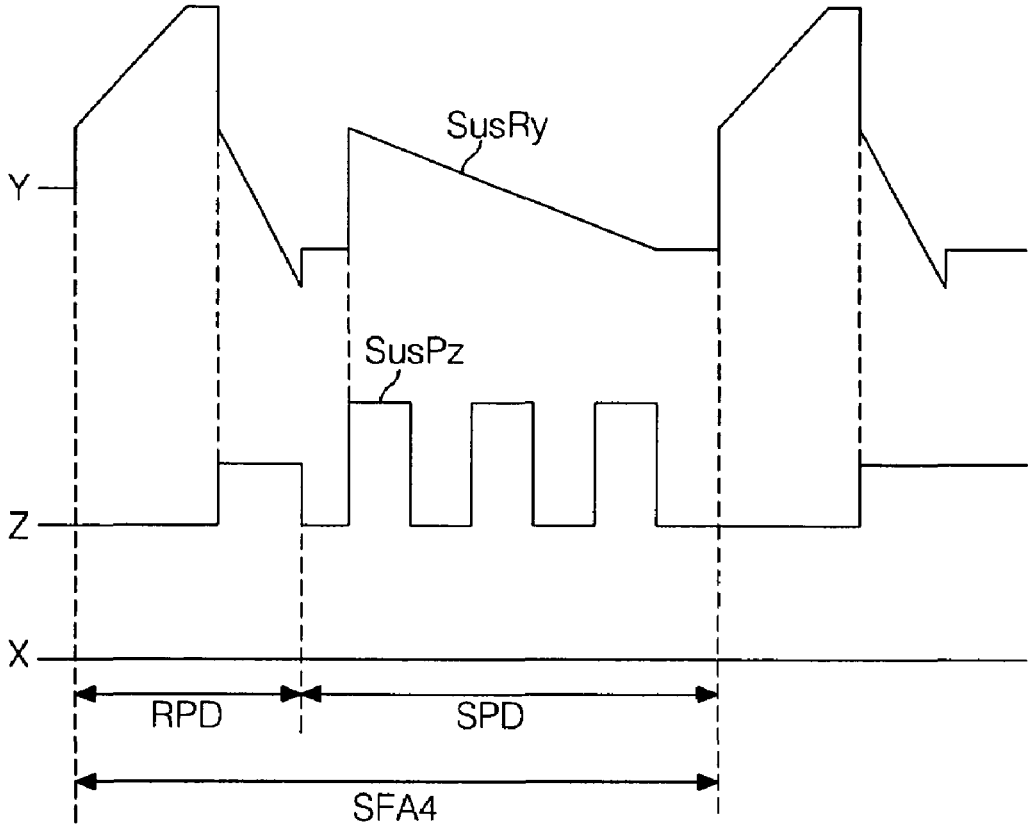
FIG. 10*a* is a view showing a fourth embodiment of driving waveforms of the PDP in accordance with the present invention.
Figure 10B:
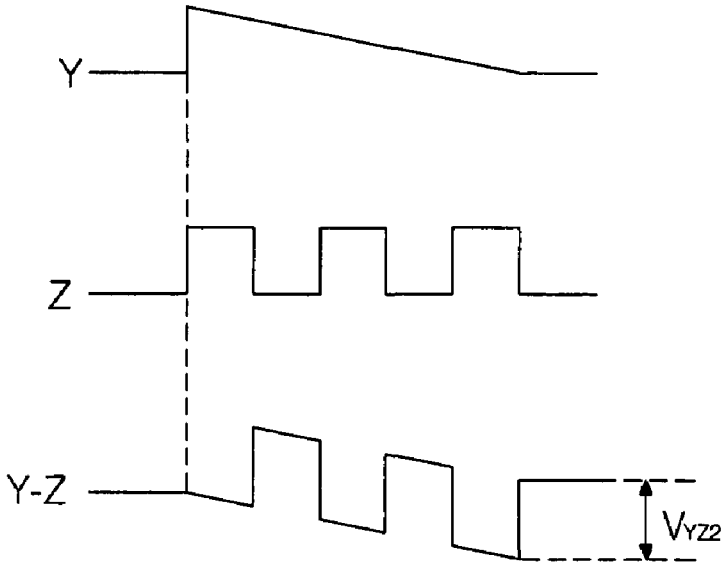
FIG. 10*b* is a view showing a voltage difference between the scan electrode and the sustain electrode when the driving waveforms according to the fourth embodiment are applied.

In a fourth embodiment of the present invention with reference to FIGS. 10*a* and 10*b*, a second waveform (SusRy) can be applied to the scan electrode (Y) and a first waveform (SusPz) can be applied to the sustain electrode (Z) during the sustain period (SPD).

Accordingly, in the fourth embodiment of the present invention, during the sustain period (SPD) during which the first waveform (SusPz) having repeated high and low potentials is applied by the sustain driver 60 and the second waveform (SusRy) falling in the ramp form from the positive polarity potential is applied by the scan driver 50, time for the source capacitor of the energy recovery unit to be charged can be secured and a preliminary time for the element of the driving circuit and the discharge cell to be turned to an activation state during an element activation sub-field (SFA4) can be secured.

Figure 1:
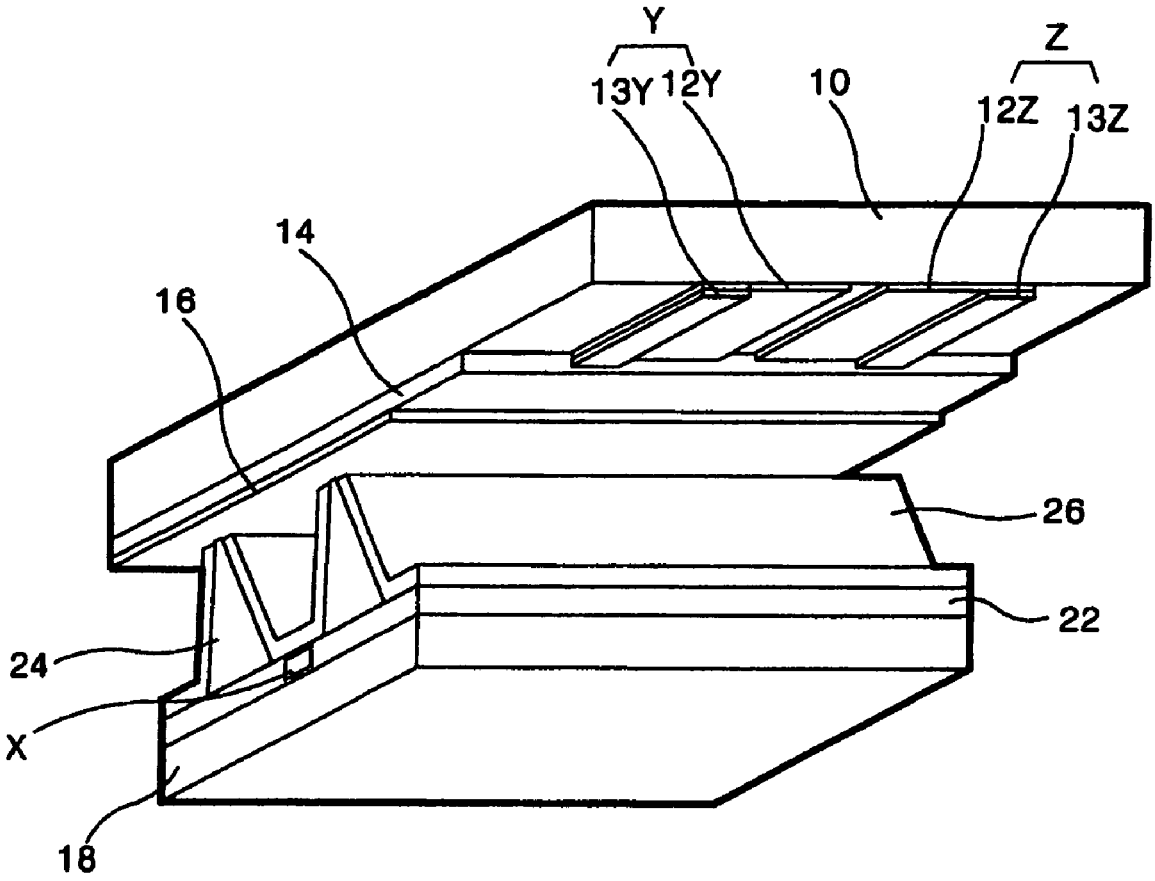
FIG. 1 (Prior Art)
FIG. 1 is a perspective view showing a discharge cell of a general plasma display panel (PDP).
Figure 2:
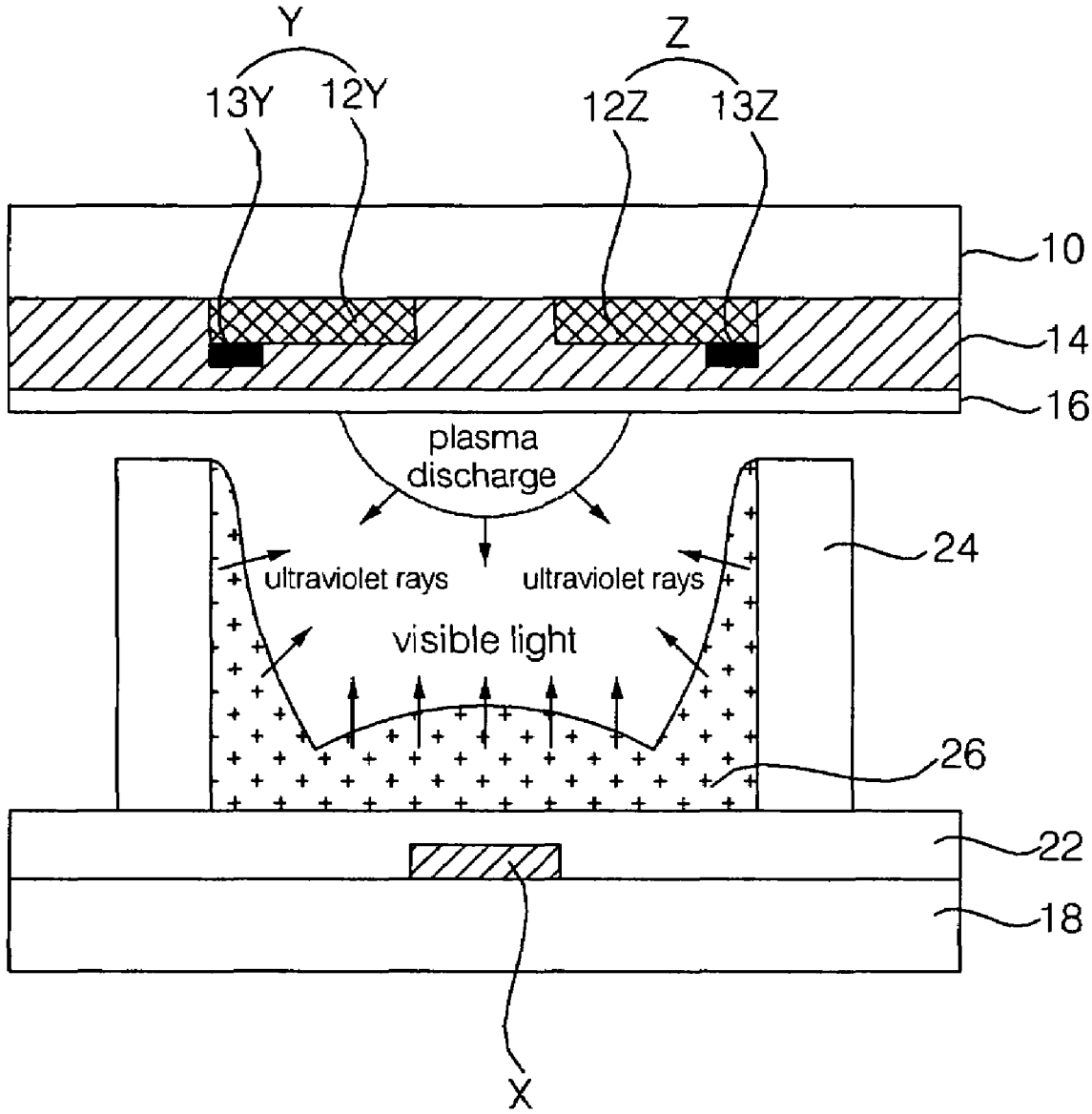
FIG. 2 (Prior Art)
FIG. 2 is a sectional view showing the discharge cell of the general PDP.
Figure 3:
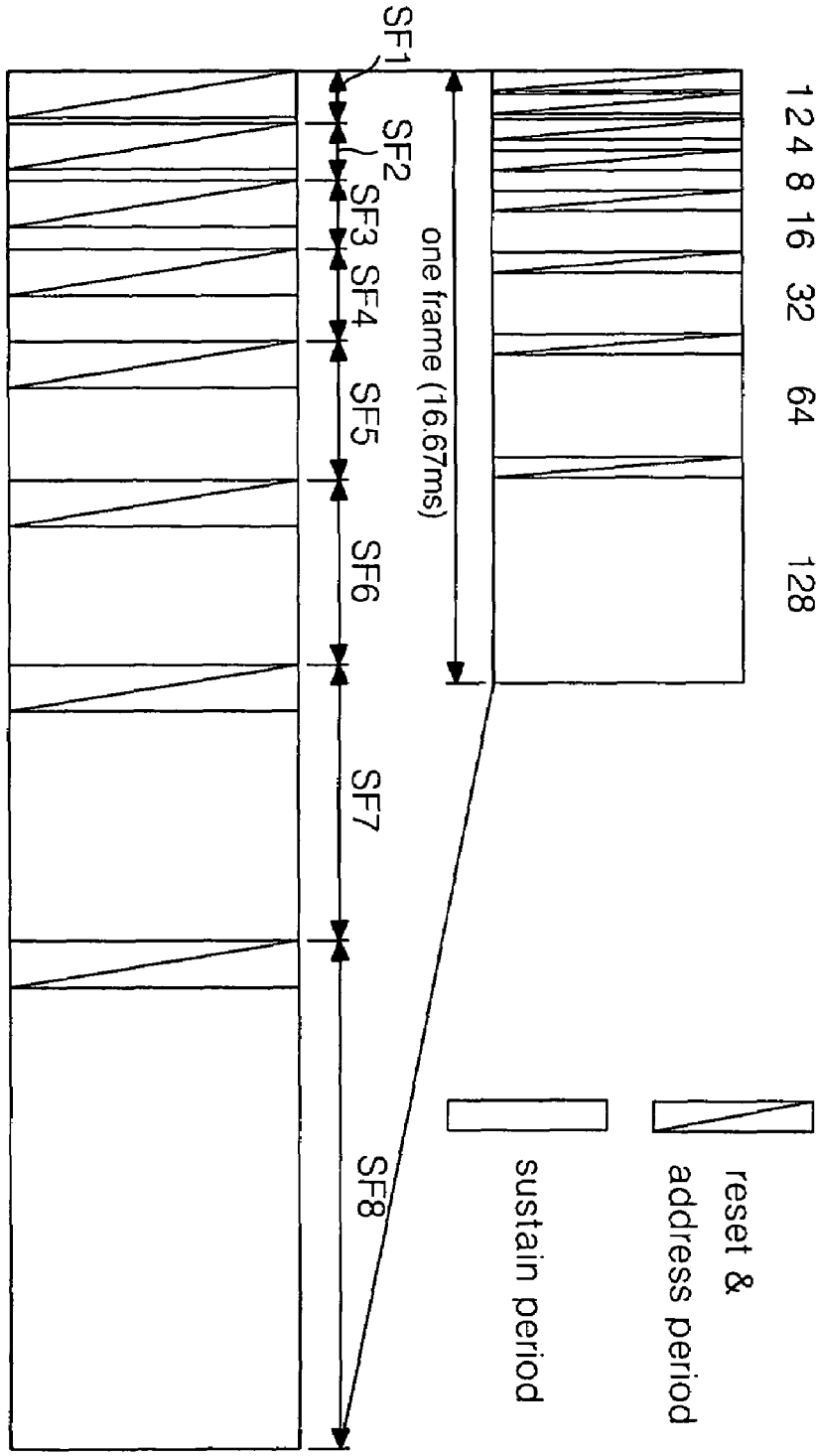
FIG. 3 (Prior Art)
FIG. 3 shows the construction of a frame implementing 256 gray levels.
Figure 4:
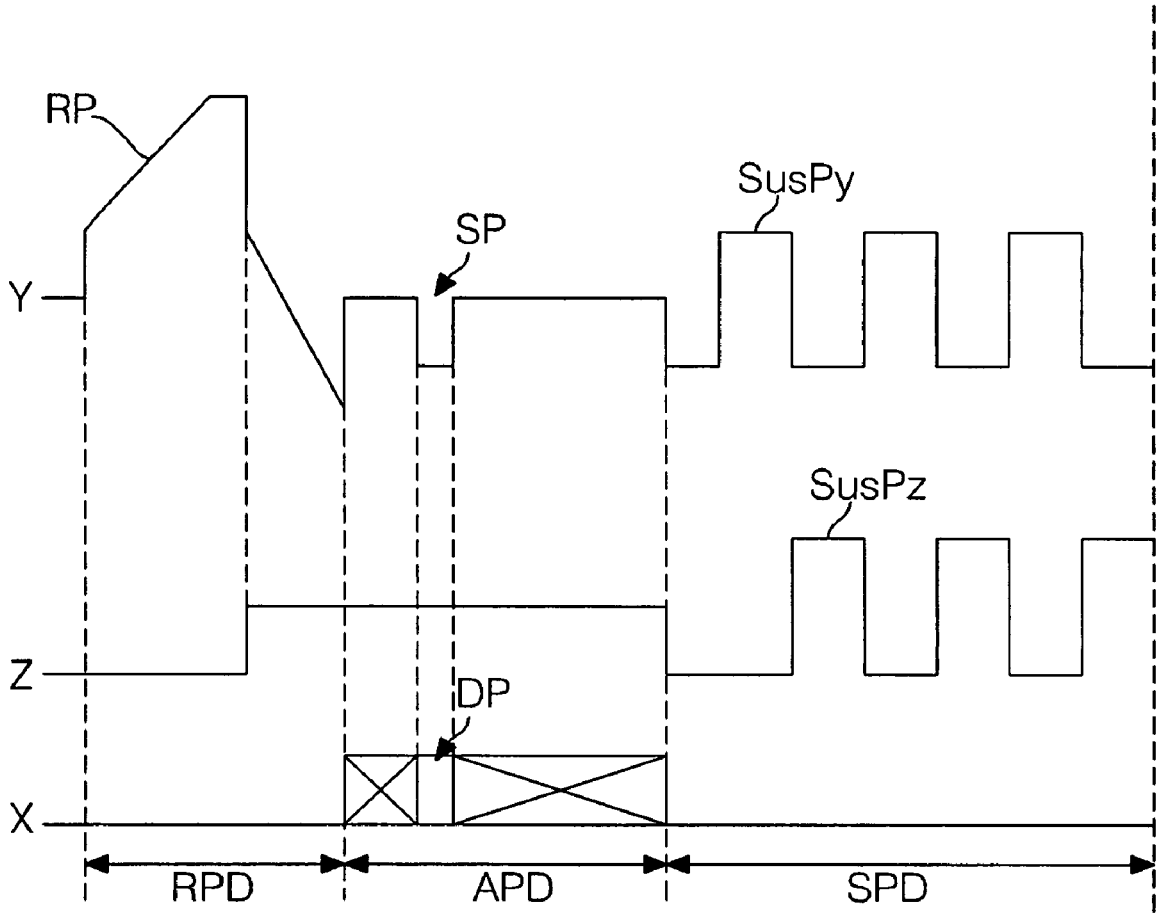
FIG. 4 (Prior Art)
FIG. 4 is a driving waveform view of the general PDP.
Figure 5:
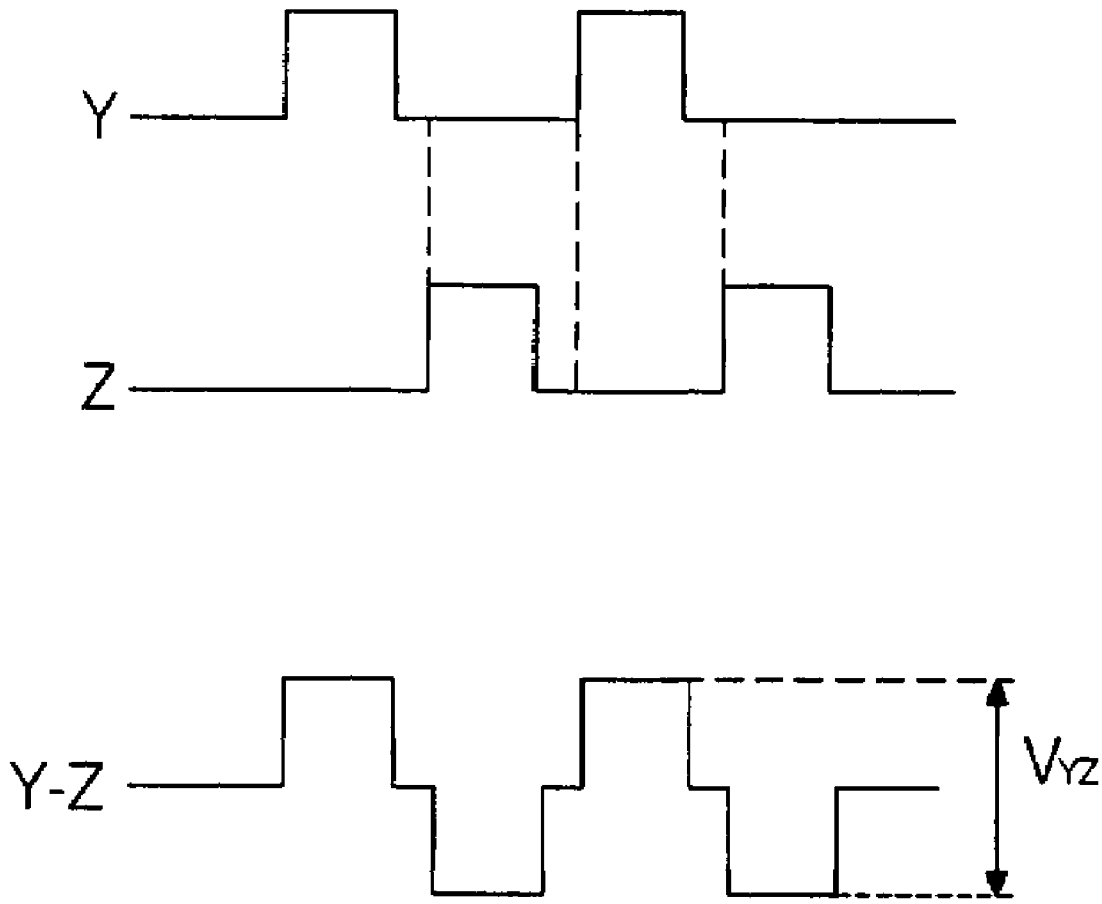
FIG. 5 is a view showing a substantial voltage difference between a scan electrode and a sustain electrode.
Figure 9A:
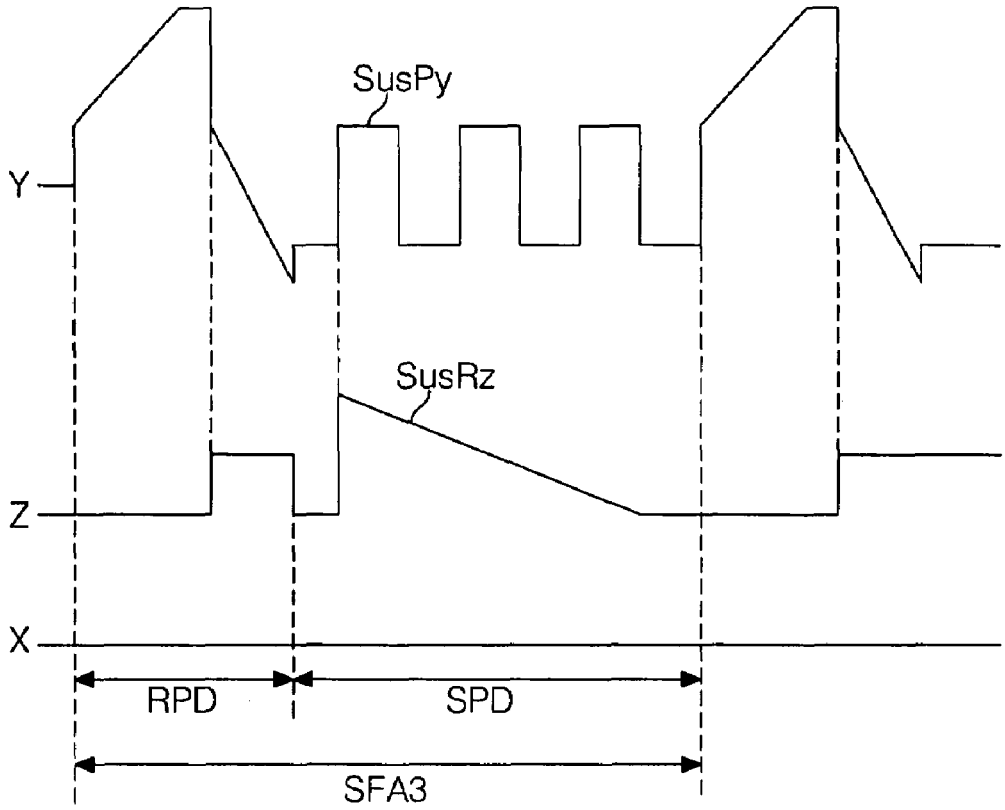
FIG. 9*a* is a view showing a third embodiment of driving waveforms of the PDP in accordance with the present invention.
Figure 9B:
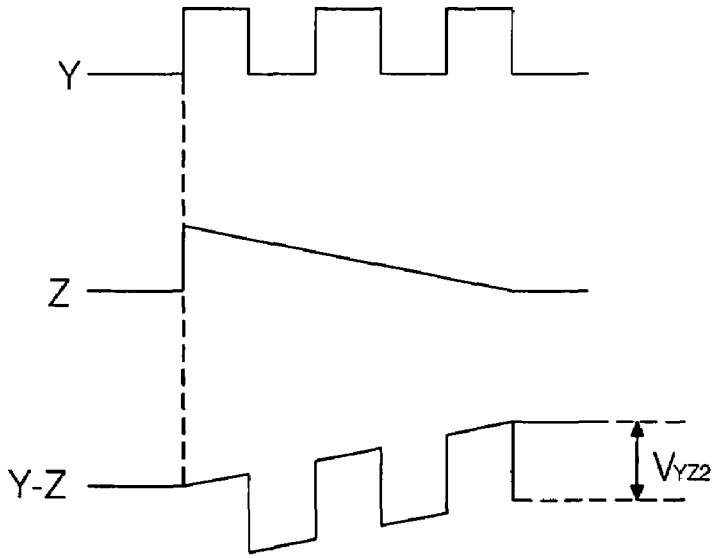
FIG. 9*b* is a view showing a voltage difference between the scan electrode and the sustain electrode when the driving waveforms according to the third embodiment are applied.

As shown in FIGS. 9*b* and 10*b*, when the driving waveforms in accordance with the third and fourth embodiments of the present invention are applied during the sustain period (SPD), a panel voltage ($V_{YZ2}$) is smaller than the panel voltage ($V_{YZ}$) of the related art as shown in FIG. 5, and since it is smaller than the sustain discharge initiation voltage, a sustain discharge does not occur.

As described above, the apparatus for driving the PDP and the driving waveforms in accordance with the first to fourth embodiments of the present invention have the following advantages.

That is, by constructing at least one or more sub-fields to have only the reset period and the sustain period right after power is supplied to the panel, time for the source capacitor of the energy recovery unit provided in the scan driver and the sustain driver to be charged with a voltage can be secured and the preliminary time for the element of the driving circuit and the discharge cell to be activated can be secured, to thereby prevent damage of the element.

The foregoing description of the preferred embodiments of the present invention has been presented for the purpose of illustration and description. It is not intended to be exhaustive or to limit the invention to the precise form disclosed, and modifications and variations are possible in light of the above teachings or may be acquired from practice of the invention. It is intended that the scope of the invention be defined by the claims appended hereto and their equivalents.

What is claimed is:

1. A method of driving a plasma display panel in which the driving is performed by time division of one frame into one or more sub-fields, wherein after power is supplied to the panel, the one or more sub-fields comprise a sustain period during which a first waveform is applied to one of a scan electrode and a sustain electrode and a second waveform different from the first waveform is applied to the other electrode, a voltage difference between the scan electrode and the sustain electrode during the sustain period is smaller than a voltage at which the sustain discharge is initiated, such that a sustain discharge does not occur, the one or more sub-fields additionally comprise a reset period during which a reset discharge occurs, the reset period being followed by the sustain period, and the first waveform is alternating, and the second waveform is non-alternating with a positive polarity.

2. The method of claim 1, wherein the one or more sub-fields exclude an address period between the reset period and the sustain period.

3. The method of claim 1, wherein the first waveform is a waveform in which a certain high voltage and low voltage are repeated, and the second waveform is a waveform in which a certain voltage level is maintained.

4. The method of claim 3, wherein the certain voltage level of the second waveform is not higher than a maximum voltage of the first waveform.

5. The method of claim 1, wherein the first waveform is a waveform in which a certain high voltage and low voltage are repeated and the second waveform is a waveform falling in a ramp form from a certain voltage level.

6. The method of claim 5, wherein the certain voltage level of the second waveform is not higher than a maximum voltage of the first waveform.

7. A method of driving a plasma display panel in which the driving is performed by time division of one frame into one or more sub-fields, wherein right after power is supplied to the panel, all the sub-fields of the one or more frames comprise a reset period during which a reset discharge occurs and a sustain period during which a first waveform is applied to one of a scan electrode and a sustain electrode and a second waveform is applied to the other electrode after the reset period, a voltage difference between the scan electrode and the sustain electrode during the sustain period is smaller than a voltage at which a sustain discharge is initiated, such that the sustain discharge does not occur, and the first waveform is alternating, and the second waveform is non-alternating with a positive polarity.

8. The method of claim 7, wherein the one or more frames exclude an address period between the reset period and the sustain period.

9. The method of claim 7, wherein the first waveform is a waveform in which a certain high voltage and low voltage are repeated, and the second waveform is a waveform in which a certain voltage level is maintained.

10. The method of claim 9, wherein the certain voltage level of the second waveform is not higher than a maximum voltage of the first waveform.

11. The method of claim 7, wherein the first waveform is a waveform in which a certain high voltage and low voltage are repeated and the second waveform is a waveform falling in a ramp form from a certain voltage level.

12. The method of claim 11, wherein the certain voltage level of the second waveform is not higher than a maximum voltage of the first waveform.

13. A plasma display panel apparatus, comprising:

a panel including one or more electrodes; and a sustain driver and a scan driver configured to drive a sustain electrode and a scan electrode, respectively, wherein after power is supplied to the panel, the scan driver applies a first waveform during a sustain period following a reset period during one or more frames to a first of the one or more electrodes, and the sustain driver applies a second waveform different from the first waveform during the sustain period to a second of the one or more electrodes;

a voltage difference between the first and the second of the one or more electrodes during the sustain period is smaller than a voltage at which a sustain discharge is initiated, such that the sustain discharge does not occur, a reset discharge occurs during the reset period, and the first waveform is alternating, and the second waveform is non-alternating with a positive polarity.

14. The apparatus of claim 13, wherein the first waveform is a sustain waveform in which a certain high voltage and low voltage are repeated, and the second waveform is a waveform in which a certain voltage level is maintained.

15. The apparatus of claim 13, wherein the first waveform is a waveform in which a certain voltage level is maintained and the second waveform is a sustain waveform in which a certain high voltage and low voltage are repeated.

16. The apparatus of claim 13, wherein the first waveform is a waveform in which a certain high voltage and low voltage are repeated and the second waveform is a waveform falling in a ramp form from a certain voltage level.

17. The apparatus of claim 13, wherein the first waveform is a waveform falling in a ramp form from a certain voltage level and the second waveform is a sustain waveform in which a certain high voltage and low voltage are repeated.

18. The apparatus of claim 13, wherein the one or more frames exclude an address period between the reset period and the sustain period.

* * * * *